US007833065B2

(12) United States Patent
Lin et al.

(10) Patent No.: US 7,833,065 B2
(45) Date of Patent: Nov. 16, 2010

(54) TRIPLE MATING CONFIGURATIONS OF CONNECTOR

(75) Inventors: Wei-Chung Lin, Tu-cheng (TW); Chih-Nan Lin, Tu-cheng (TW); Jui-Kuang Chung, Tu-cheng (TW); Wei-Te Chung, San Jose, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 84 days.

(21) Appl. No.: 12/290,219

(22) Filed: Oct. 28, 2008

(65) Prior Publication Data

US 2009/0111330 A1 Apr. 30, 2009

Related U.S. Application Data

(60) Provisional application No. 61/000,827, filed on Oct. 29, 2007.

(51) Int. Cl.
*H01R 25/00* (2006.01)

(52) U.S. Cl. ..... 439/639; 439/638

(58) Field of Classification Search ..... 439/159, 439/630, 638, 639, 660, 722
See application file for complete search history.

(56) References Cited

U.S. PATENT DOCUMENTS 5,304,069 A * 4/1994 Brunker et al. ..... 439/108
6,666,696 B1 * 12/2003 Wu ..... 439/108
7,625,243 B2 * 12/2009 Chen et al. ..... 439/660
7,744,426 B2 * 6/2010 Zheng et al. ..... 439/660
2010/0136848 A1 * 6/2010 Lin et al. ..... 439/701

* cited by examiner

*Primary Examiner*—Edwin A. Leon
*Assistant Examiner*—Vanessa Girardi
(74) *Attorney, Agent, or Firm*—Andrew C. Cheng; Wei Te Chung; Ming Chieh Chang

(57) ABSTRACT

An electrical connector includes: an insulative housing defining a front mating cavity; a mating tongue extending into the front mating cavity and defining thereon first and second mating faces opposite to each other, said mating tongue dividing said mating cavity into a first mating space confronting the first mating face for mating with a first complementary connector, and a second mating space confronting the second mating face for mutually exclusively mating with second and third complementary connector; a plurality of first type contacts disposed on the first mating face for connecting with the first complementary connector, a plurality of second type contacts disposed on the second mating face for connecting with the second complementary connector, and a plurality of third type contacts located between the first type contacts and the second type contacts with front ends of the third type contacts exposed to the second mating space.

18 Claims, 18 Drawing Sheets

TRIPLE MATING CONFIGURATIONS OF CONNECTOR

PRIORITY CLAIM

This application claims benefit of priority of provisional application Ser. No. 61/000,827 title "TRIPLE MATING CONFIGURATIONS OF CONNECTOR" file on Oct. 29, 2007, whose inventor is Wei Te Chung with the same assignee.

BACKGROUND OF THE INVENTION

1. Field of the Invention

The present invention relates to electrical connectors, more particularly to electrical connectors compatible to both standard Universal Serial Bus (USB) connectors and Serial Advanced Technology Attachment (SATA) connectors, especially to External Serial Advanced Technology Attachment (ESATA).

2. Description of Related Art

A copending application Ser. No. 11/818,100 discloses a new design USB 3.0 connector which contains additional five contacts in comparison with the standard USB 2.0 connector while still keeping the similar mating port dimension thereof so as to be compatible with the standard USB 2.0 connector, thus assuring there is no conflict therebetween during the upgrading transition period.

On the other hand, some variation of USB 2.0 connector was presented in which a combo type connector which somewhat enlarged the mating port dimension so as to provide another space for receiving a SATA connector in the same mating port.

The invention is to provide a triple combo type connector which is mateable with the standard USB 2.0 connector, USB 3.0 connector and the SATA connector, respectively.

BRIEF SUMMARY OF THE INVENTION

An electrical connector includes an insulative housing enclosed by a metallic shell. A mating cavity is formed in a front portion of the housing, and a terminal module receiving cavity is formed in a rear portion of the housing. A terminal module includes an insulator assembled to the housing with a front section thereof extends into the mating cavity and a rear section thereof is received in the terminal module receiving cavity. The front section essentially is a mating tongue having opposite first and second mating faces respectively confronting a first mating space and a second mating space which share the different portions of the same mating cavity. A plurality of first type contacts are disposed on the first mating face, a plurality of second type contacts are disposed on the second mating face, and a plurality of third type contacts are embedded within the insulator, optimally via an insert molding process, and essentially located in a middle level of said insulator so as to be located between the first type contacts and the second type contacts under a condition that the front ends of the third type contacts are also exposed toward the second mating space.

Another feature of the instant invention is that the first type contacts are the SATA connector contacts, the second type contacts are the standard USB 2.0 connector contacts, and the second type contacts cooperate with the third type contacts are the USB 3.0 connector contacts, and thus the first mating space receives a SATA plug connector, and the second mating space receives either a USB 2.0 plug connector or a USB 3.0 plug connector.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
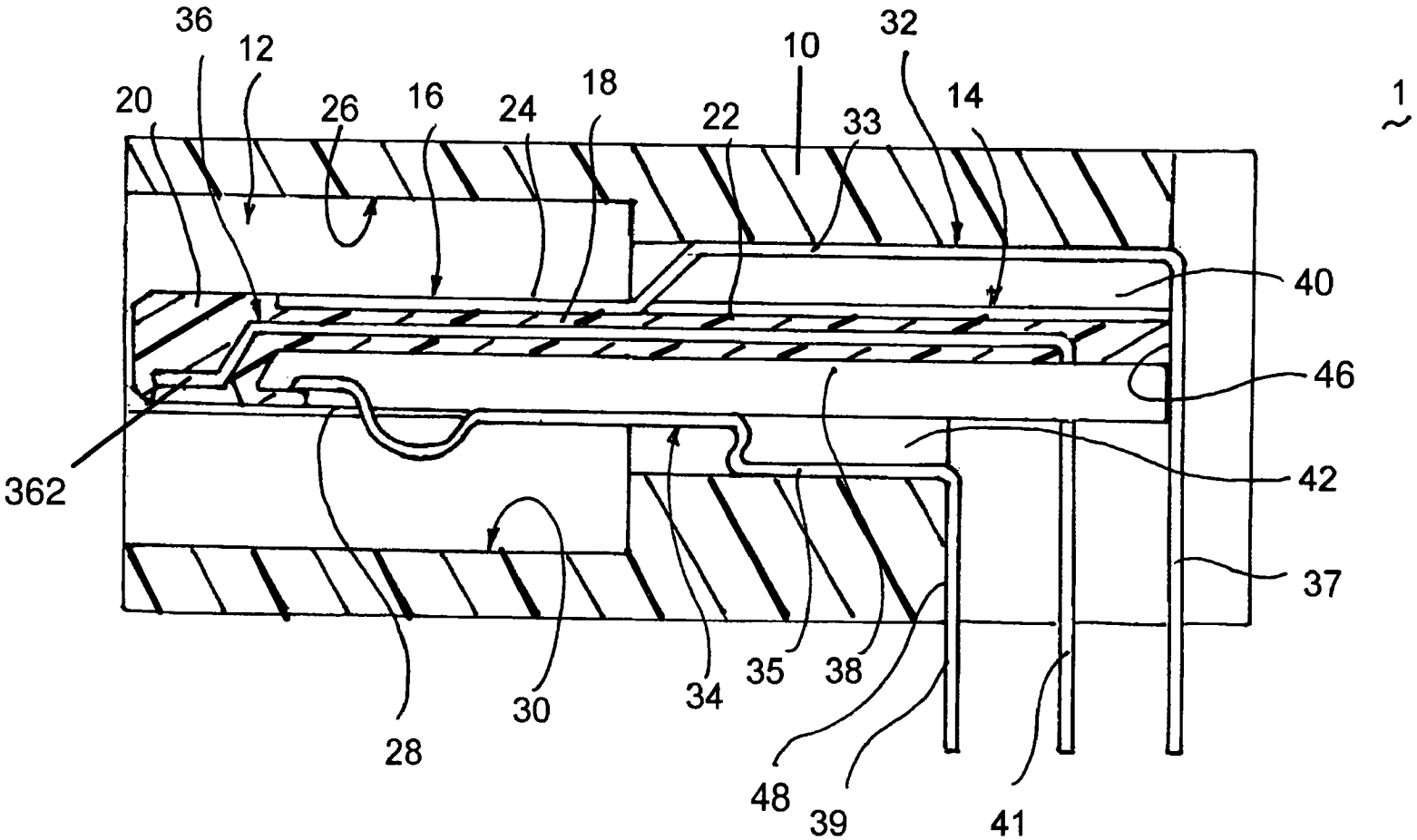
FIG. 1 is a cross-sectional view of an electrical connector of a first embodiment of the instant invention, taken along a step configuration planar surfaces rather than a vertical plane for easy illustration purpose, because the first type contact, the second type contact and the third type contact do not lie in a same vertical plane.
Figure 2:
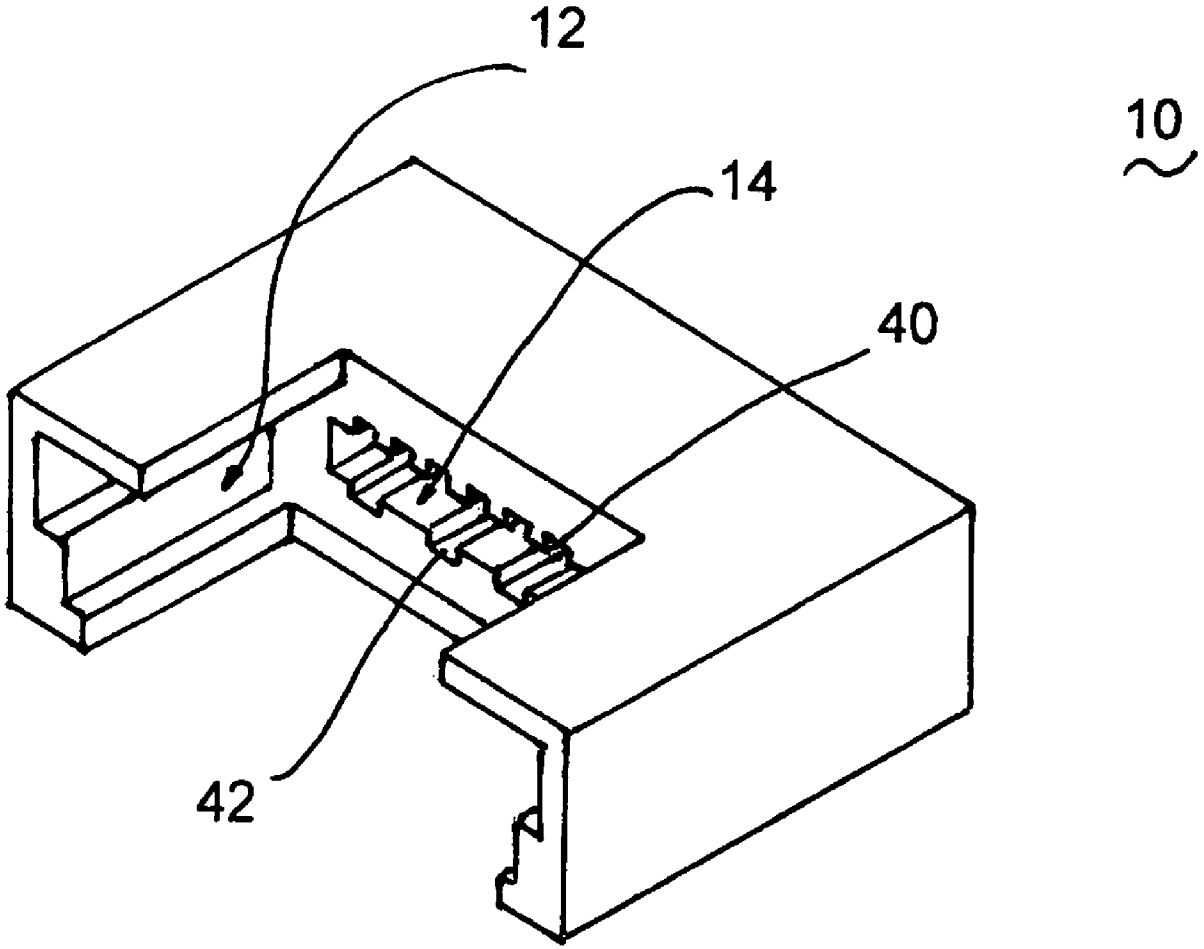
FIG. 2 is a perspective view of the insulative housing of the connector in FIG. 1.
Figure 3:
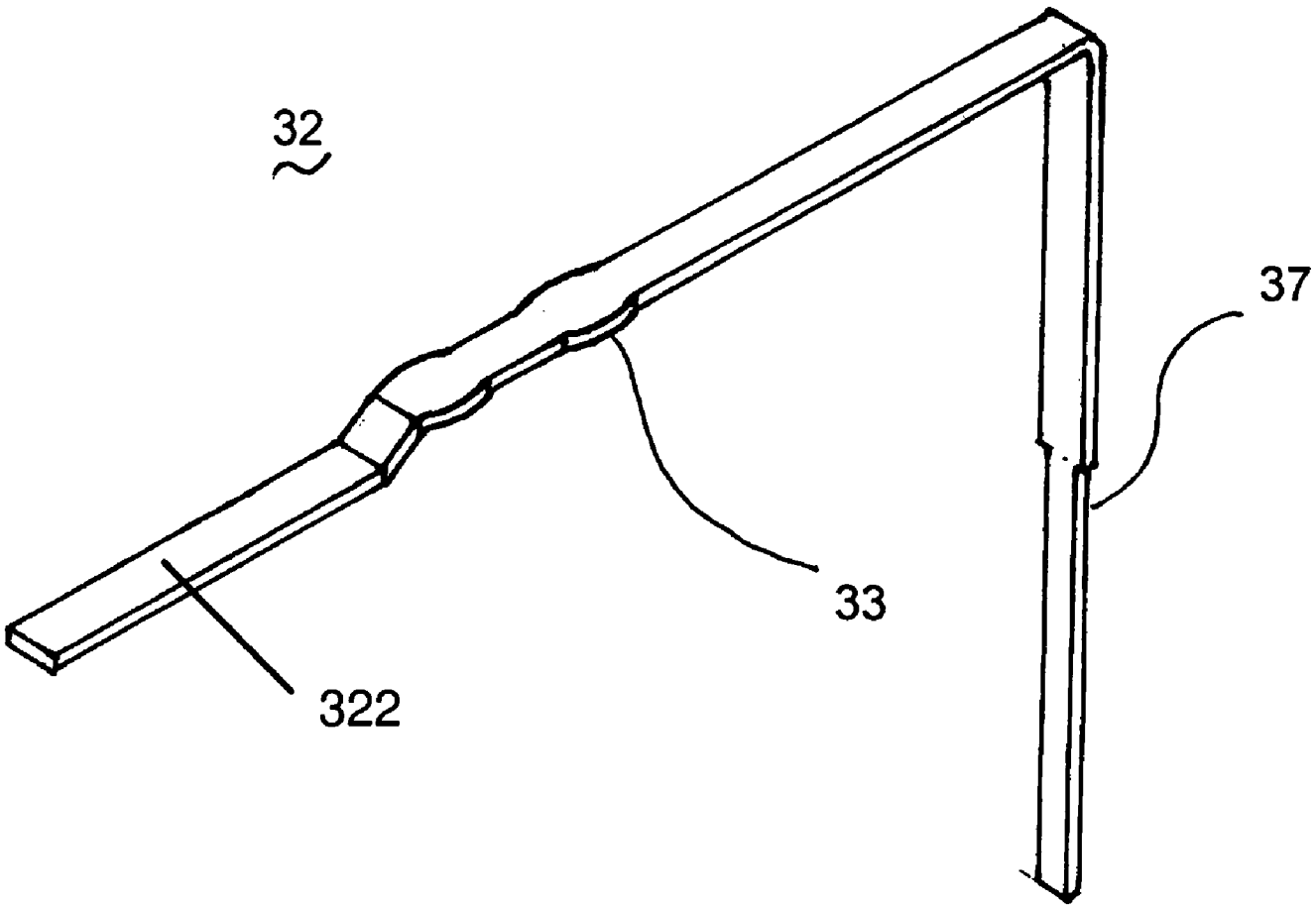
FIG. 3 is a perspective view of the first type contact.
Figure 5:
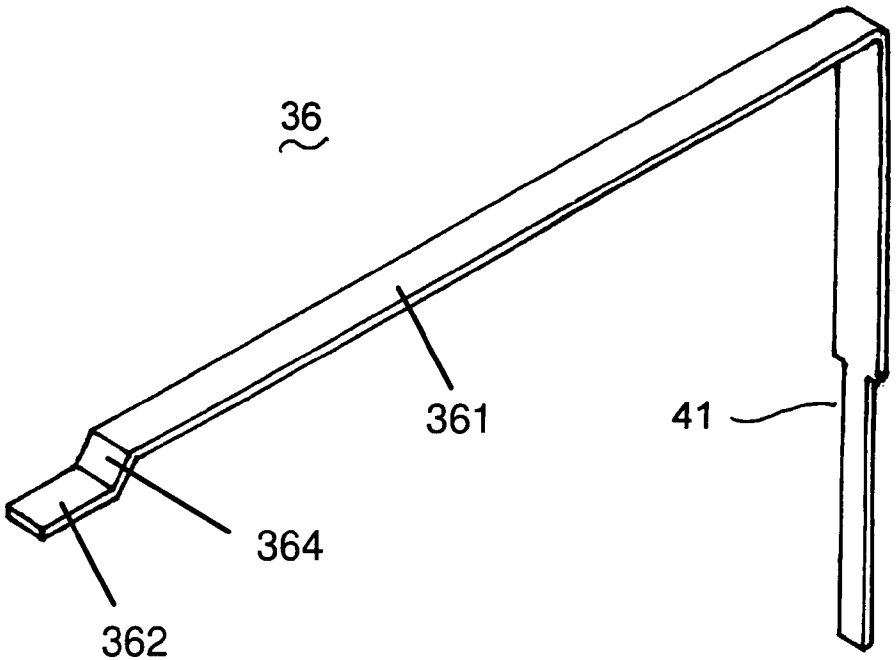
FIG. 5 is a perspective view of the third type contact.
Figure 4:
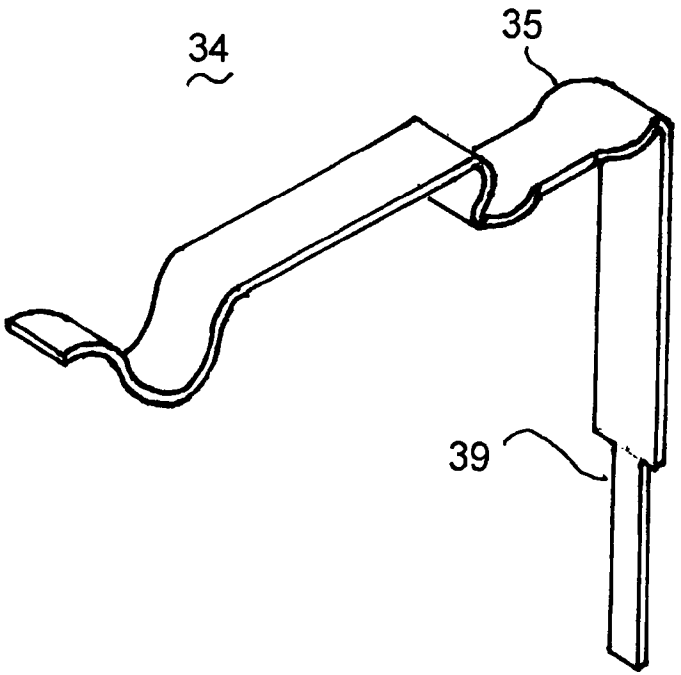
FIG. 4 is a perspective view of the second type contact.
Figure 6:
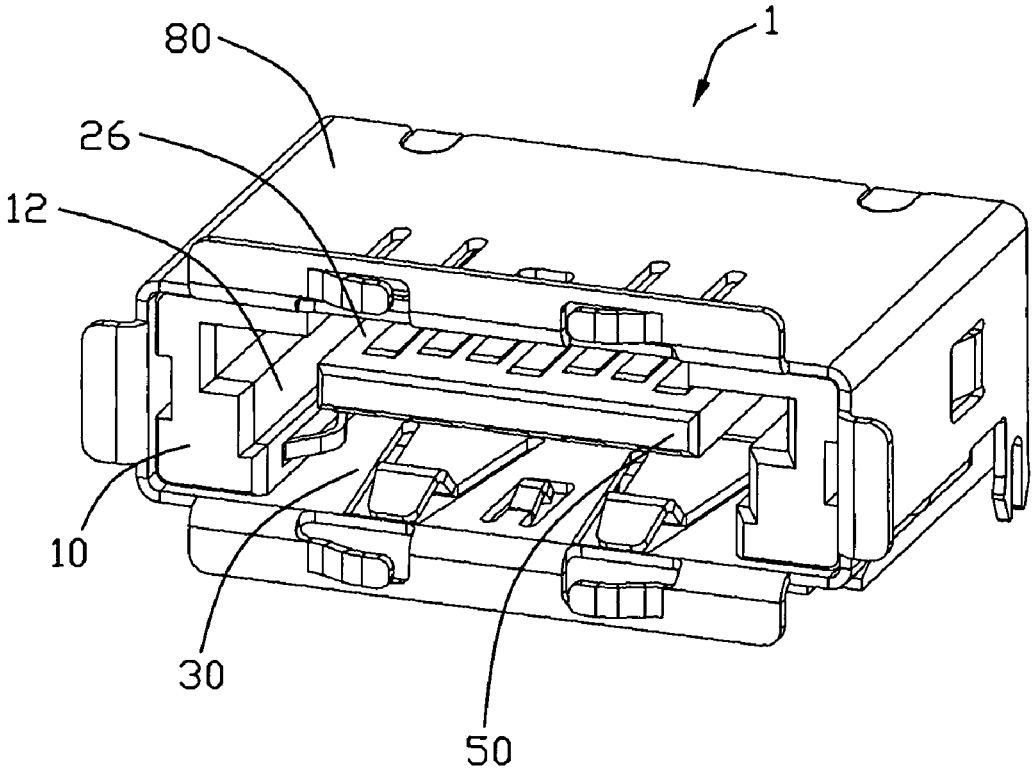
FIG. 6 is a detailed perspective view of an electrical connector of second embodiment of the instant invention viewed from a top direction.

Reference will be made to the drawing figures to describe the present invention in detail, wherein depicted elements are not necessarily shown to scale and wherein like or similar elements are designated by same or similar reference numeral through the several views and same or similar terminology. The same elements are designated by same reference numeral and terminology through the eight embodiments.

Referring to FIGS. 1-5 showing a first embodiment which are schematic views used to convey basic meaning, an electrical connector 1 includes an insulative housing 10 enclosed in a metallic shell (not shown). The housing defines a front mating cavity 12 and a rear terminal module receiving cavity 14 communicating with each other in a front-to-back direction. A terminal module 16 discrete from the housing 10, includes an insulator 18 assembled to the housing 10 wherein the front section 20 of the terminal module 16 extends into the mating cavity 12, and a rear section 22 is received in the terminal module receiving cavity 14. The front section 20 is essentially a mating tongue defining a first mating face 24 confronting a first mating space 26 in the mating cavity 12, and a second mating face 28, opposite to the first mating face 24, confronting a second mating space 30 in another portion of the mating cavity 12.

A plurality of first type contacts 32 are disposed on the first mating face 24, a plurality of second type contacts 34 are disposed on the second mating face 28, and a plurality of third type contacts 36 are embedded within the insulator 18 optimally via an insert molding procedure and essentially located in a middle level of the insulator 18 so as to be located between the first type contacts 32 and the second type contacts 34 under a condition that the front ends of the third type contacts 36 are also exposed toward the second mating space 30.

The first type contacts 32, with an amount of seven, are the SATA connector contacts, the second type contacts 34, with an amount of four, are the standard USB 2.0 connector contacts, and the second type contacts 34 cooperate with the third type contacts 36, with an amount of five, are the USB 3.0 connector contacts, and thus the first mating space 26 receives a SATA plug connector, and the second mating space 30 receives either a USB 2.0 plug connector or a USB 3.0 plug connector.

The insulator 18 defines a plurality of internal passageways 38 to allow the corresponding second type contacts 34 to be deflectably received therein. The housing 10 includes a plurality of first passage 40 around the first mating space 26 and in communication with the terminal module receiving cavity 14 in a first direction to retain the rear portion of the first type contacts 32 therein, and a plurality of second passage 42 around the second mating space 30 and in communication with the terminal module receiving cavity 14 via a second direction, opposite to the first direction, to retain the rear portion of the second type contacts 34. As shown, the first type contact 32 has the retention section 33 by two sides for interference with the corresponding first passage 40, and the second type contact 34 has the retention section 35 by two sides for inference with the corresponding second passage 42. The vertical mounting tail 37 of the first type contact 32 abuts against a back face 46 of the insulator 18, and the vertical mounting tail 39 of the second type contact 34 abuts against the back face 48 of the housing 10, while the vertical mounting tail 41 of the third type contact 36 is confined by the insulator 18. It is noted that in the embodiment the first type contact 32 and the second type contact 34 are intentionally arranged away from the third type contact 36 around the terminal module receiving cavity 14. It is noted that in the embodiment the second type contacts are of the resilient type while the first type contacts and the third type contacts are of the stiffness type.

The third type contact 36 includes a longitudinal retention portion 361 and a stiffness contacting portion 362 parallel to and below the retention portion 361. The contacting portion connects with the retention portion by a jointing portion 364 and the contacting portion and the jointing portion has a same width with the retention portion 361 in a traverse direction perpendicular to a longitudinal direction of the contact. As best shown in FIG. 1, the front end of the first type contact 32 is located at the back of the contacting portion 362 of the third type contacts. The front end of the second type contact is also at the back of the contacting portion 362 of the third type contacts.

Referring to FIGS. 6-11 showing a second embodiment which illustrate detailedly, wherein the description of the same elements to the first embodiment are omitted, an electrical connector 1 includes an insulative housing 10 enclosed in a metallic shell 80. A front mating cavity 12 enclosed by the insulative housing and the shell is divided into a first mating space 26 and a second mating space 30 by a mating tongue 50.

Figure 7:
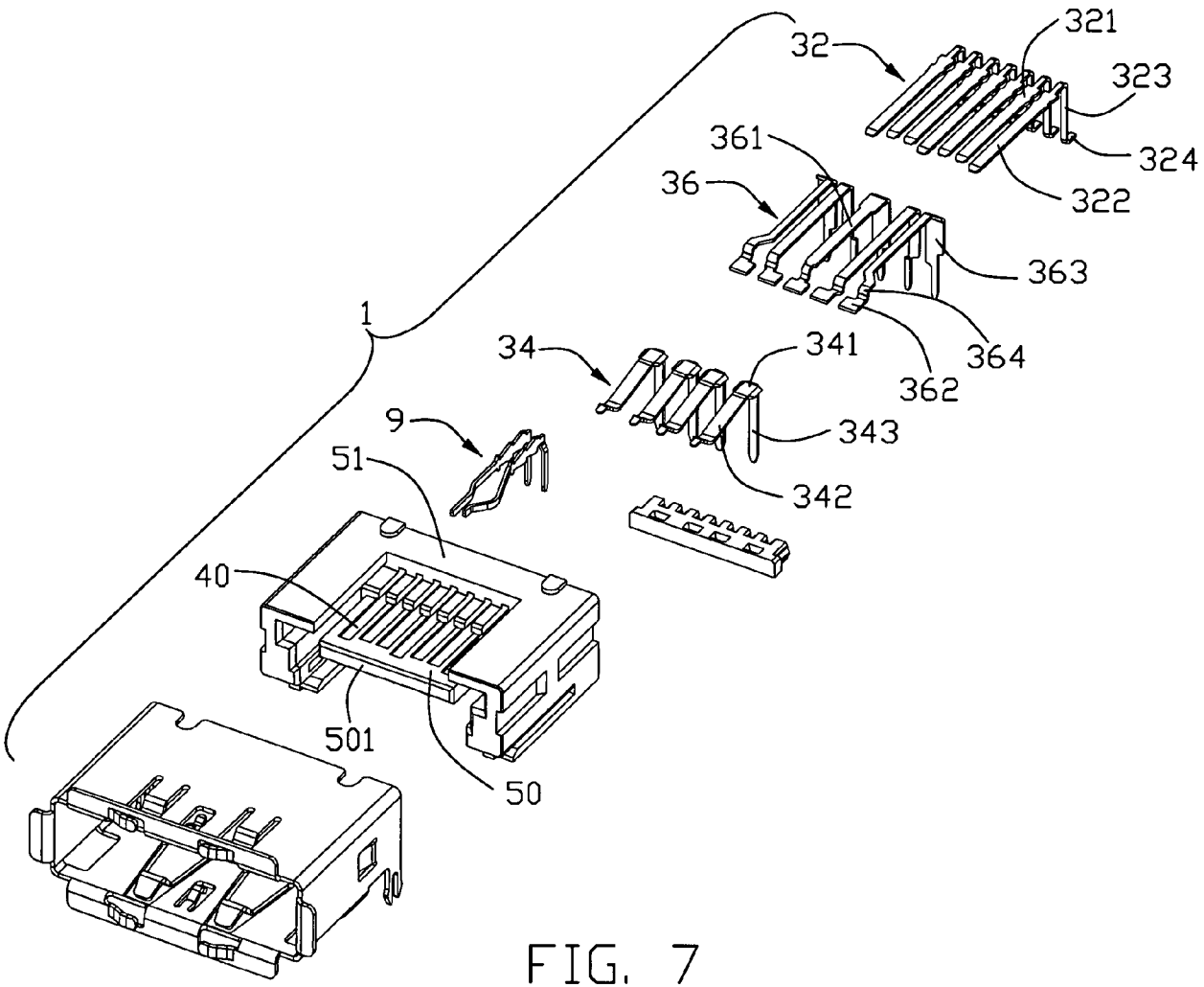
FIG. 7 is an exploded perspective view of the electrical connector in FIG. 6.
Figure 8:
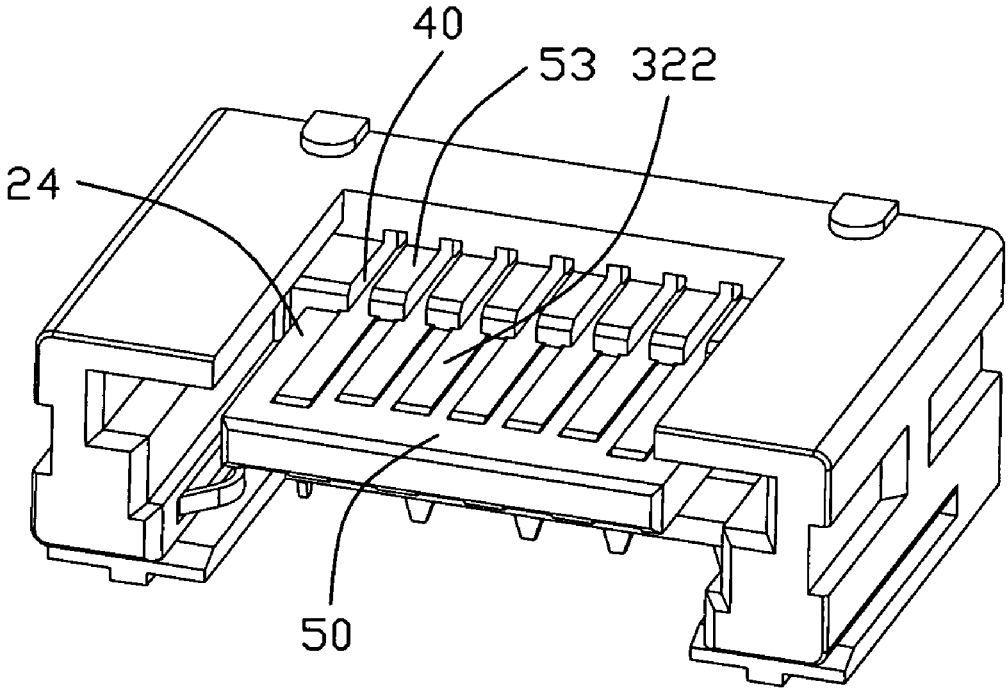
FIGS. 8 and 9 are perspective views of the housing with contacts of the electrical connector in FIG. 7 viewed from a top and a bottom direction, respectively.

As shown in FIG. 7, a plurality of first type contacts 32, with an amount of seven, are the eSATA connector contacts, the second type contacts 34 are the standard USB 2.0 connector contacts, and the second type contacts 34 cooperate with the third type contacts 36, with an amount of five, are the USB 3.0 connector contacts. The first type contact 32 includes a retention portion 321, a board shaped stiffness contacting portion 322 extending from a front end of the retention portion and a connecting portion 323 with a parallel soldering portion 324 extending downwards from a rear end of the retention portion. The first type contacts 32 is inserted into corresponding first passage 40 which runs forwards from a rear wall 51 of the housing but do not pierce a front face 501 of the mating tongue 50. As shown in FIG. 8, a thickening portion 53 is added to the top face 24 of the mating tongue 50 at an intersection of the mating tongue and the rear wall 51, and the first passages 40 run through the thickening portion 53 so that the retention portion 321 fitly interferences with the first passage 40. The contacting portions 322 receive in the first passages 40, are located on the top face, i.e. the first mating face 24, of the mating tongue 50 and exposes to the first mating space 26.

Figure 9:
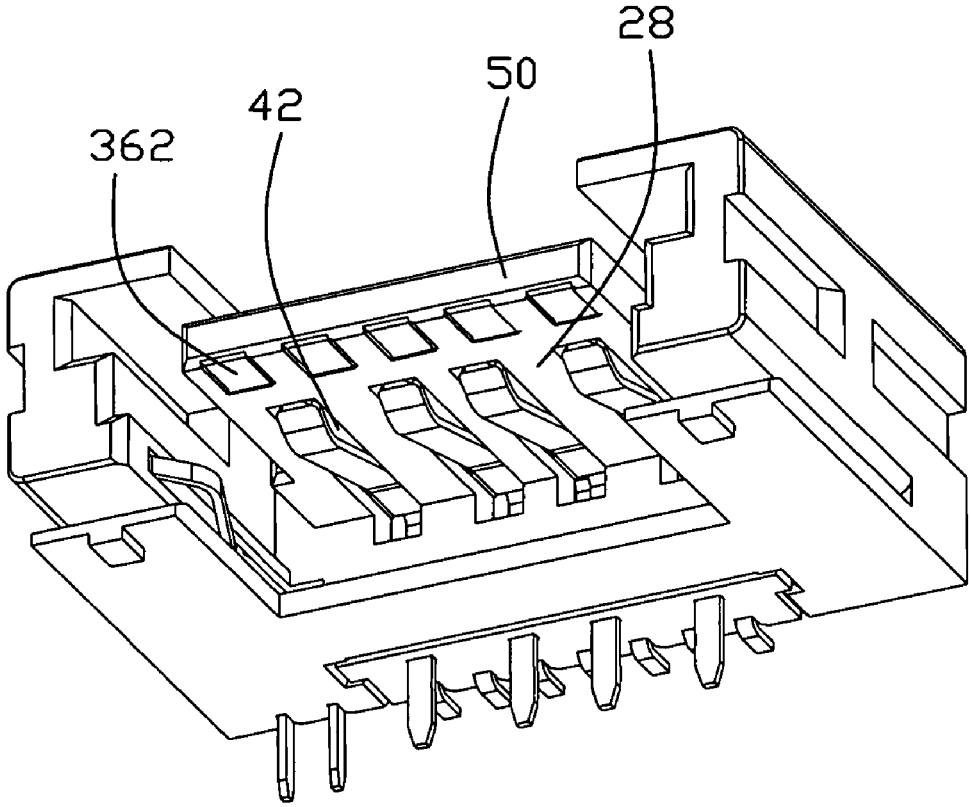

As shown in FIGS. 7 and 9, the second type contact 34 includes a retention portion 341, an arc resilient contacting portion 342 extending from a front end of the retention portion and a connecting portion 343 extending downwards from a rear end of the retention portion. The second type contacts 34 are inserted into corresponding second passage 42 and the contacting portions are located in the bottom surface of the mating tongue 50 and protrude into the second mating space 30. The front ends of the passages 42 distance from the front face 501 of the mating tongue 50 with a predetermined distance so as to set the third type contacts 36 as described hereinafter.

The third type contact 36 includes a longitudinal retention portion 361, an stiffness contacting portion 362 and a connecting portion 363 extending downwards from a rear end of the retention portion. The contacting portions 362 are parallel to and below the retention portion 361 connecting by a jointing portion 364. The five contacting portions 362 enlarge in a traverse direction perpendicular to the longitudinal direction of the contact and the front portions of the retention portion 361 of two contacts in outermost bent outwards so that the enlarged contacting portions 362 have enough space to be arranged. The contacting portions 362 located in the second mating face 28 of the mating tongue 50 and exposing to the second mating space 30, are located in front of the second type contact 42 and offset in the traverse direction.

Figure 11:
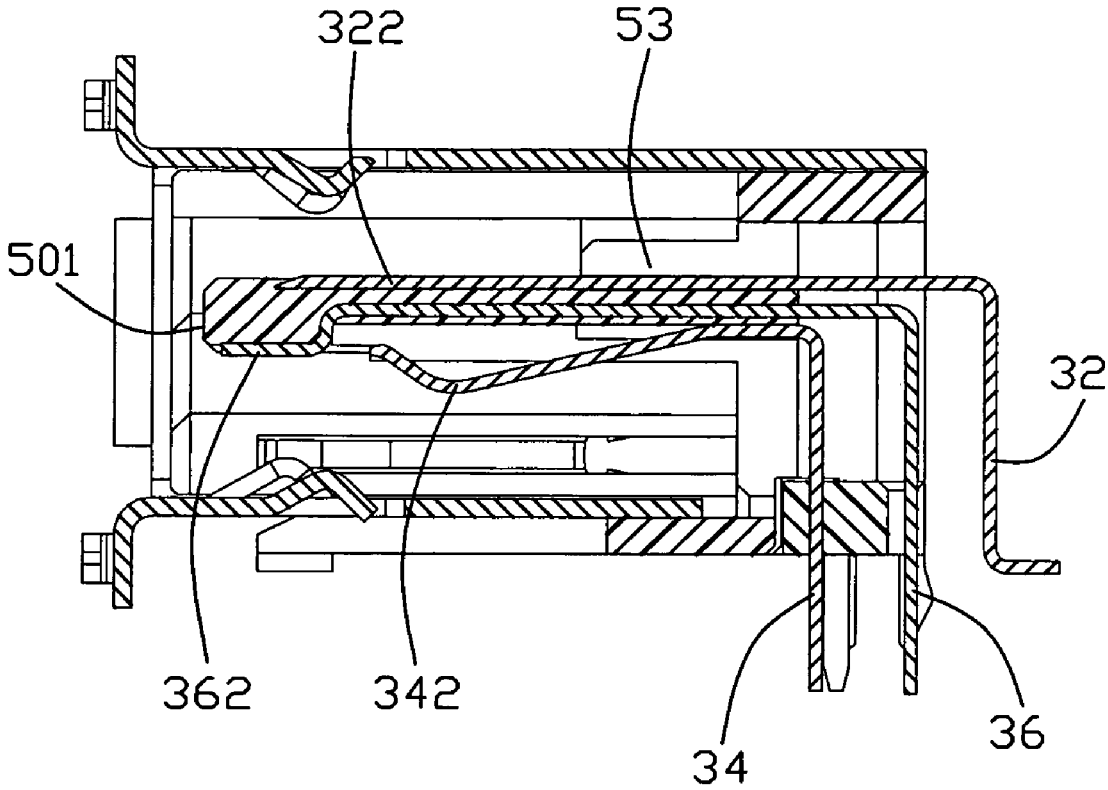
FIG. 11 is a schematic cross-sectional view of the electrical connector in FIG. 6, taken along a step configuration planar surfaces rather than a vertical plane, which is similar to FIG. 1.

Please referring to FIG. 11, the third type contacts 36 is embedded within the mating tongue 50 via an insert molding procedure when molding the insulative housing 10 with the mating tongue 50, and then the first and second type contacts 32, 34 are inserted into the top and bottom face of the mating tongue 50, respective. The contacting portion of the third type contact 36 is mainly nearer to the front face 501 of the mating tongue than the front end of the first type contact and the contacting portion 342 of the second type contact 34.

Figure 10:
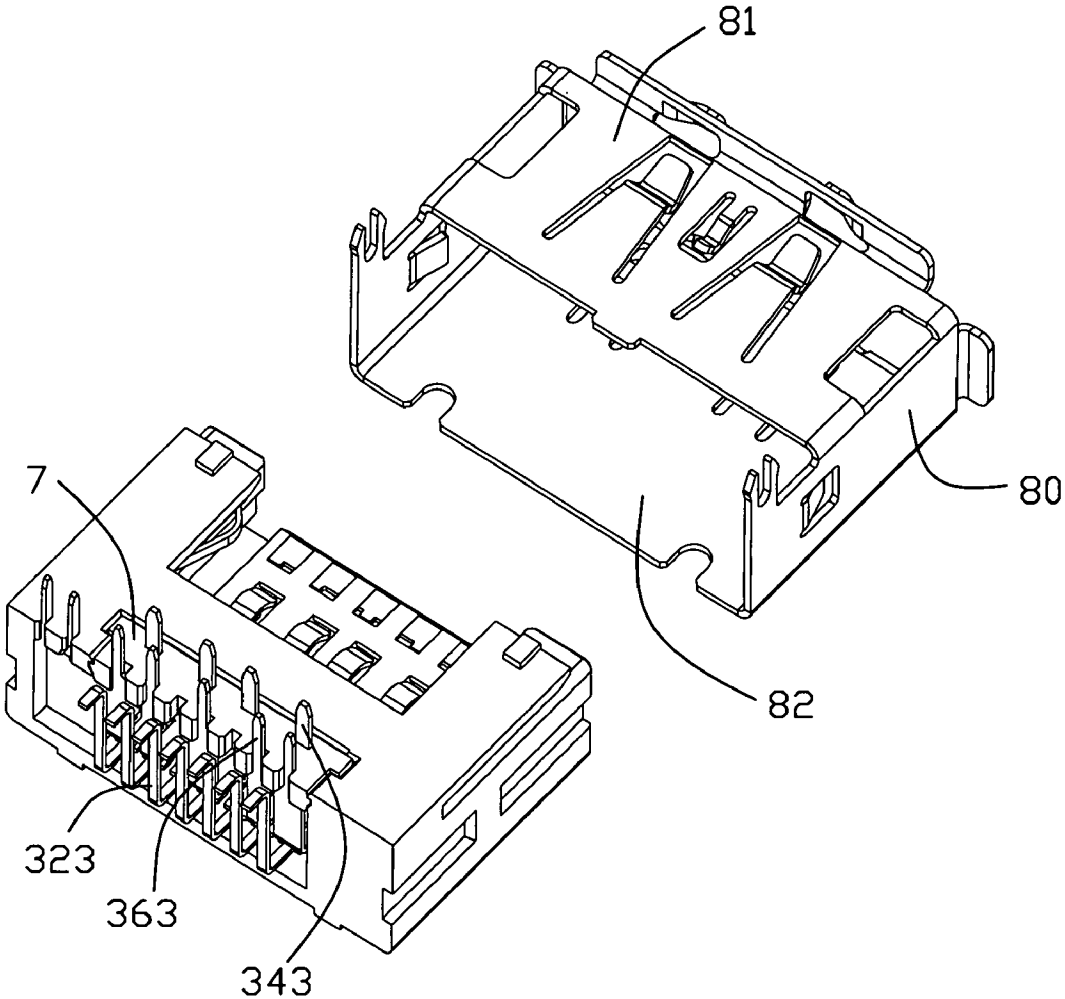
FIG. 10 is a partly exploded view of the electrical connector in FIG. 6.

As shown in FIGS. 7 and 10, the connecting portions of the contacts of said three types are arranged in one row, respectively. An insulative spacer 7 is received and retained in the rear portion of the housing to support the connecting portions. The shell 80 is enclosed a periphery of the insulative housing and a top and bottom wall 81, 82 act as top and bottom walls of the electrical connector 1. A pair of detecting pins 9 are arranged in the housing.

Figure 12:
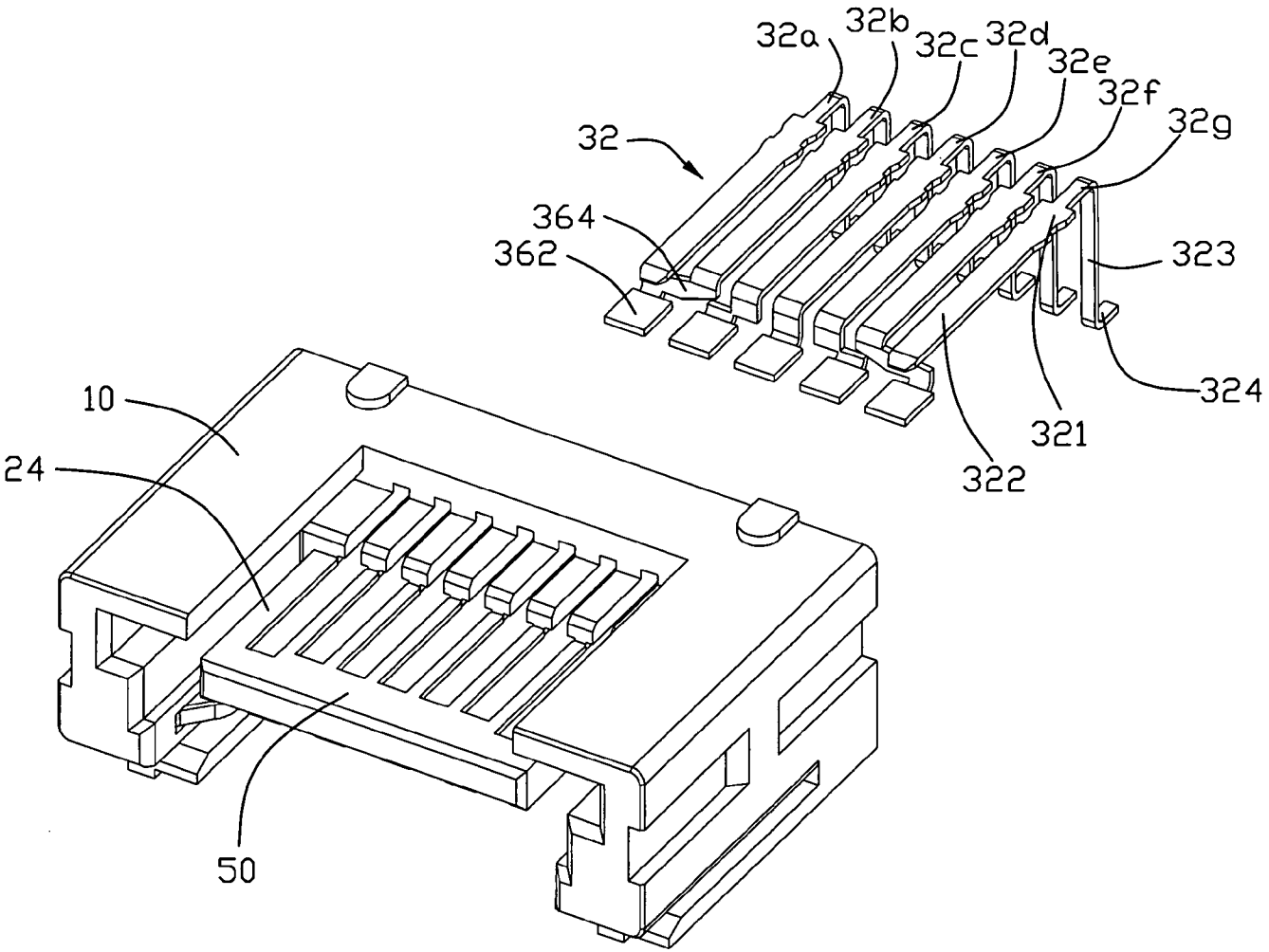
FIG. 12 is a partly exploded view of an electrical connector of a third embodiment.
Figure 13:
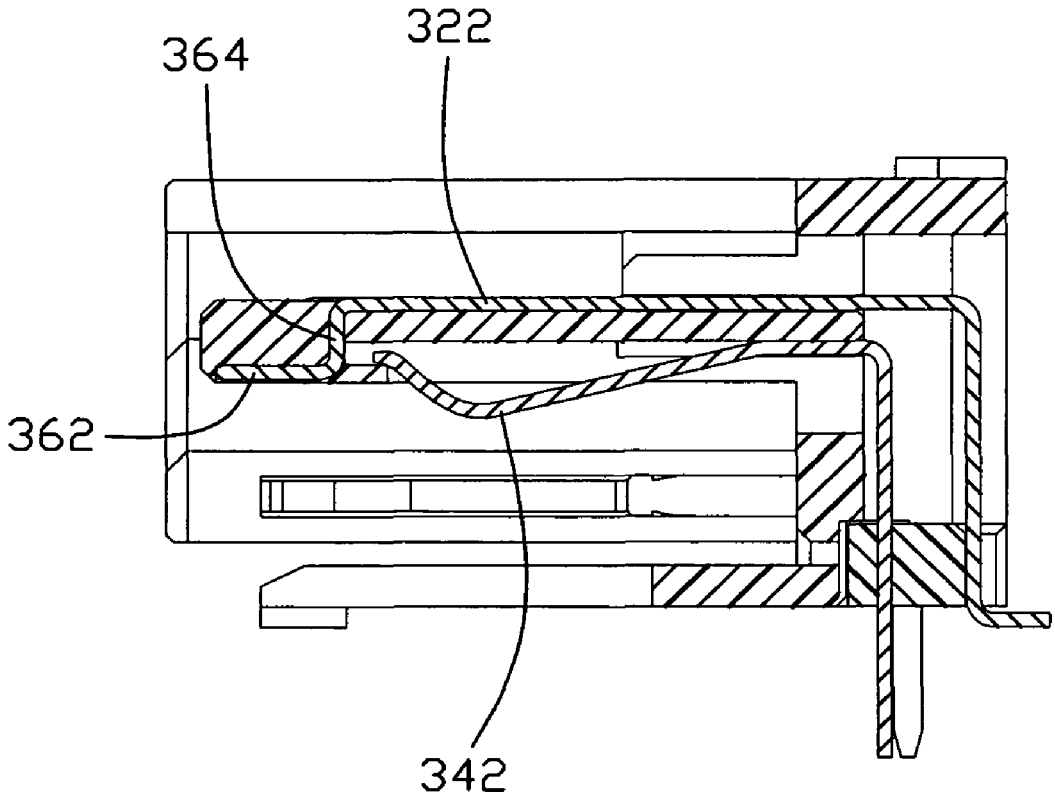
FIG. 13 is a schematic cross-sectional view of the electrical connector in FIG. 12, taken along a step configuration planar surfaces rather than a vertical plane, which is similar to FIG. 1.

Referring to FIGS. 12 and 13 showing a third embodiment, which is similar to the second embodiment except the first and the third type contacts therefore the description of the elements same to the second embodiment are omitted. A plurality of second type contacts 34 are the standard USB 2.0 connector contacts as aforementioned embodiments. A plurality of first type contacts 32, with an amount of seven, are the ESATA connector contacts. Each first type contact 32 includes a retention portion 321 with barbs by sides thereof, a stiffness contacting portion 322 parallel extending forwards from a front end of the retention portion and a connecting portion 323 extending downward from a rear end of the retention portion with a parallel soldering portion 324. Five contacts 32*b*~32*f* located between two opposite outermost contacts 32*a*, 32*g*, each further include a further contacting portions 362. The further contacting portions 362 are in the front of the contacting portion 322 and located in the second mating face 28 opposite to the first mating face 24 of the mating tongue 50.

The further contacting portion 362 connects with corresponding contacting portion 322 by a jointing portion 364 respectively. The further contacting portions 362 are enlarged in the traverse direction and arranged at a same interval substantially under a condition that the contacting portion of the middle contact 32*d* is in the centre line of the contact 32*d* while the further contacting portions of the remainders 32*b*, 32*c* 32*e*, 32*f* offset from the centre line of the four contact. The further contacting portion 362, with an amount of five, are used for mating with a USB 3.0 plug together with the five contacting portion 342 of the second type contacts 34. In other word, the five 32*b*~32*f* of the seven first type contacts are adapted for USB 3.0 and ESATA alternatively in accordance with the insertion of the plug type. For convenience and understand, the contacting portions 322 of the first type contact 32 adapted for mating with corresponding ESATA plug is named as the first contacting portion, the contacting portions 342 of the second type contacts 34 adapted for mating with corresponding standard USB 2.0 plug is named as the second contacting portions, and the further contacting portions 362 of the first type contact 32, adapted for mating with corresponding USB 3.0 together with the second contacting portion, are named as the third contacting portions.

The jointing portions 364 are perpendicular to the first and third contacting portion 322, 362. The jointing portions 364 of the contacts 32*b*, 32*c*/32*e*, 32*f* gradually elongates in the traverse direction so as to arrange the third contacting portions.

Figure 14:
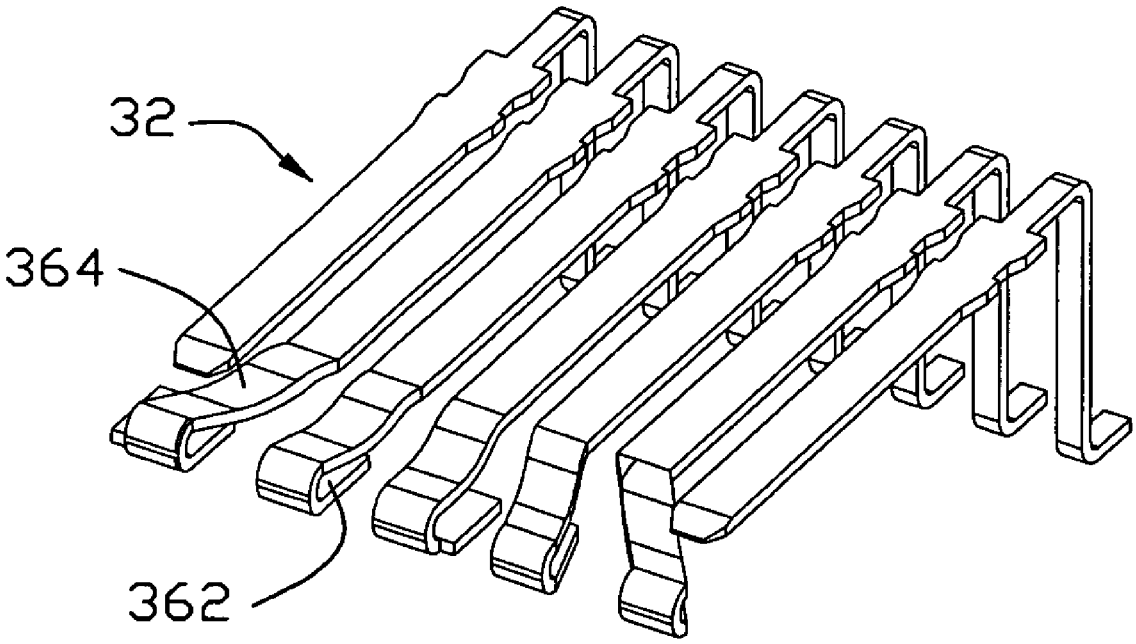
FIG. 14 is a perspective view of a plurality of first type contacts of a forth embodiment.
Figure 15:
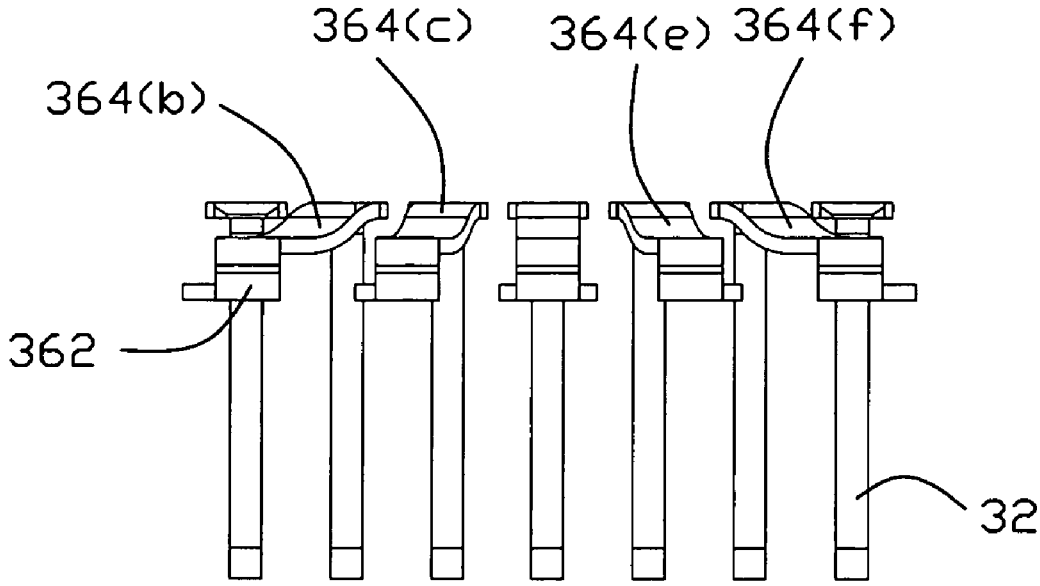
FIG. 15 is a top view of the first type contacts in FIG. 14.
Figure 16:
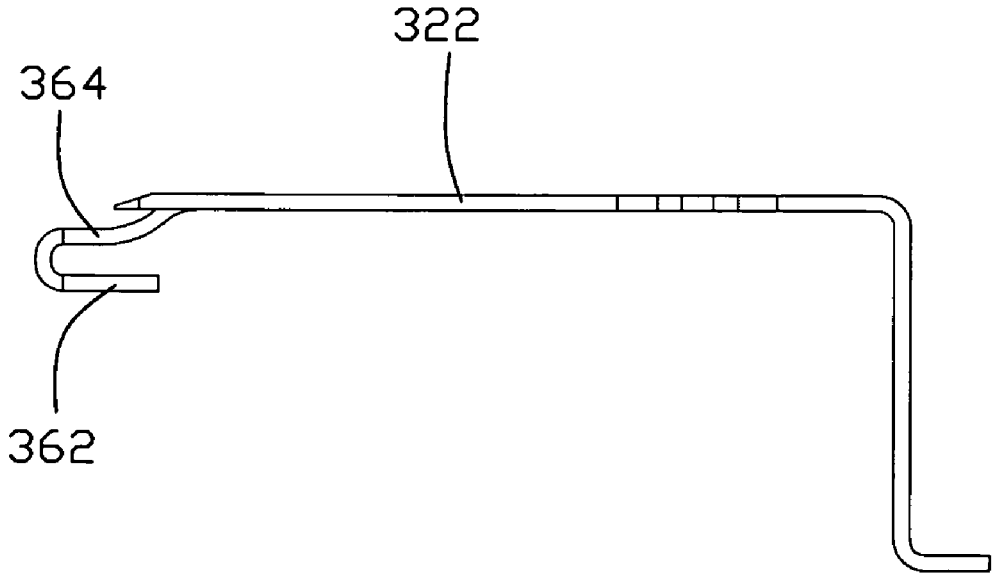
FIG. 16 is a side view of the first type contacts in FIG. 14.
Figure 17:
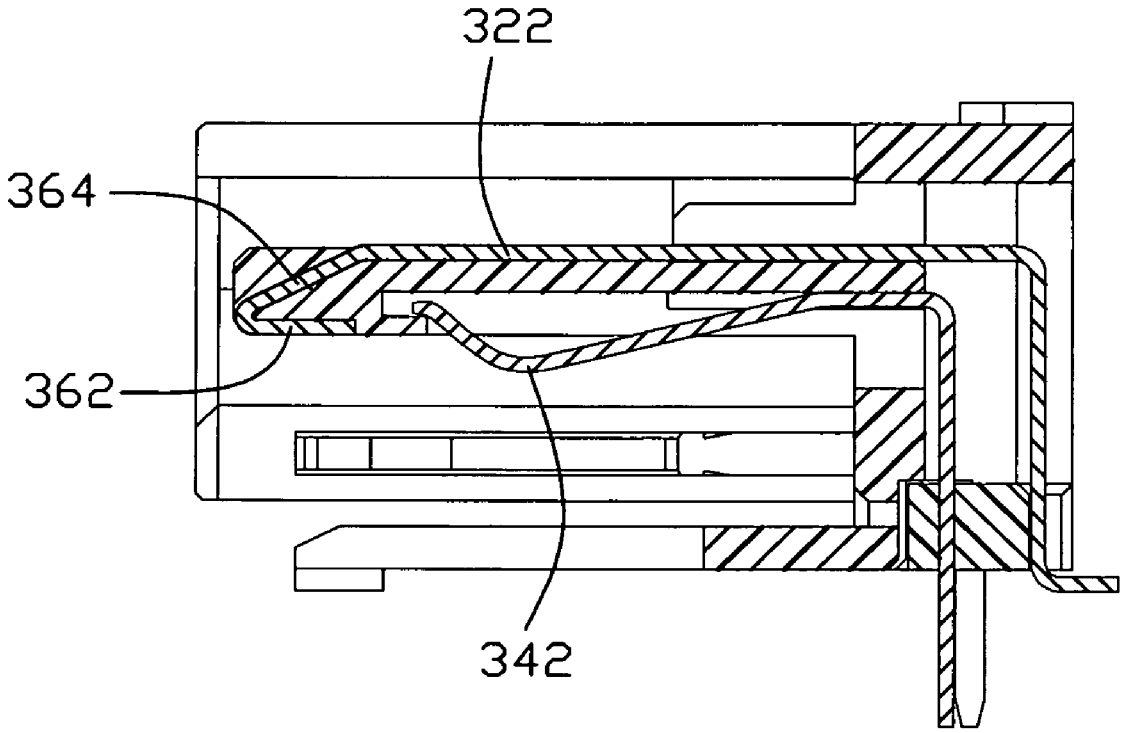
FIGS. 17~20 are schematic cross-sectional views of electrical connectors of other embodiments, taken along a step configuration planar surfaces rather than a vertical plane, which are similar to FIG. 1.
Figure 18:
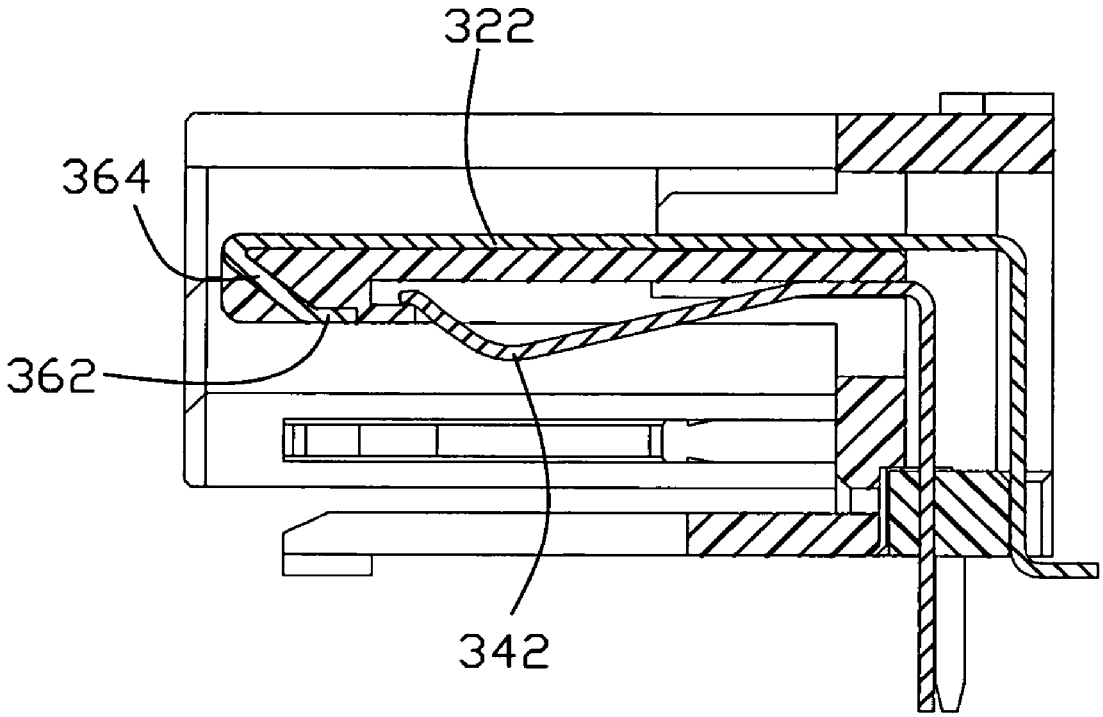
Figure 19:
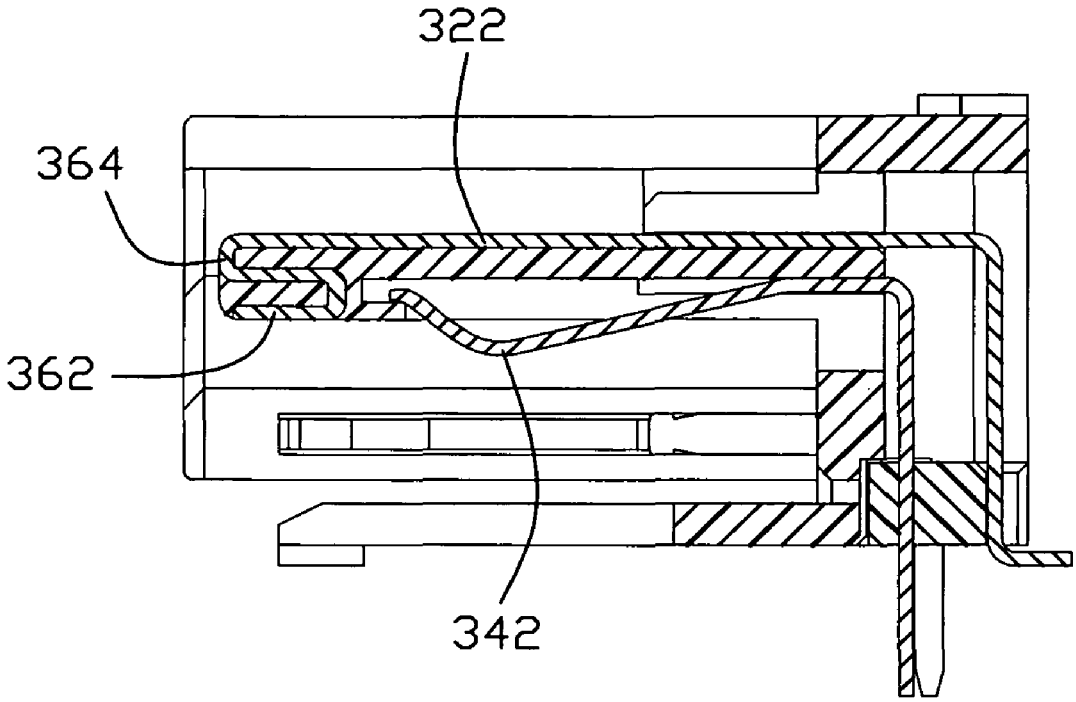
Figure 20:
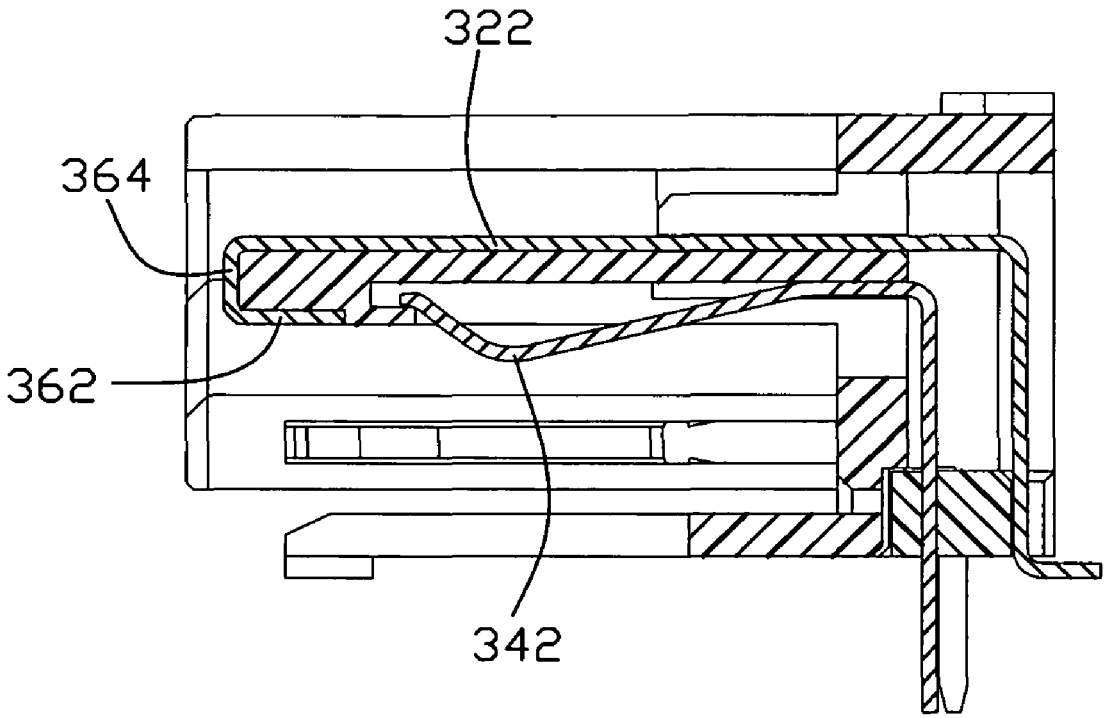

Referring to FIGS. 14~16 showing a four embodiment, whose configuration and contacts' arrangement are similar to the third embodiment except the details of jointing portions 364 therefore the description of the elements same to the third embodiment are omitted. The jointing portions 364 bend downwards and forward, and then inwards to form the third contacting portion 362. The outer four jointing portions 364 gradually shift outwards simultaneously to left enough space for arrangement the enlarged third contacting portions 362.

Referring to FIGS. 17~20 showing other embodiments, whose configuration and contacts' arrangement are similar to the third embodiment except the details of jointing portions 364 for forming the third contacting portions 362. The jointing portion 364 in FIG. 17 bends downward and forwards in a diagonal pattern from the front end of the first contacting portion 322 to form the third contacting portion 362. The jointing portion 364 in FIG. 18 extends forward from the first contacting portion 322 and then bends downward and inwards in a diagonal form to form the third contacting portion 362. The jointing portion 364 in FIG. 19, extends forwards from the first contacting portion 322 and vertical bends downward and to form the third contacting portion 362. The jointing portion 364 in FIG. 20 extends forwards from the first contacting portion 322 and parallel bends inwards to form the third contacting portion 362.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector comprising:

an insulative housing defining a front mating cavity;

a mating tongue extending into the front mating cavity and defining thereon first and second mating faces opposite to each other, said mating tongue dividing said mating cavity into a first mating space confronting the first mating face for mating with a first complementary connector, and a second mating space confronting the second mating face for mutually exclusively mating with second and third complementary connector;

a plurality of first type contacts disposed on the first mating face for connecting with the first complementary connector, a plurality of second type contacts disposed on the second mating face for connecting with the second complementary connector, and a plurality of third type contacts located between the first type contacts and the second type contacts with front ends of the third type contacts exposed to the second mating space.

2. The electrical as described in claim 1, wherein the third type contacts are embedded in the mating tongue via an insert molding procedure.

3. The electrical connector as described in claim 1, wherein first contacting portions of the first type contacts expose towards the first mating space, second contacting portions and third contacting portion expose toward the second mating space.

4. The electrical connector as described in claim 3, wherein the third contacting portions are arranged adjacent to a front face of the mating tongue compared with the second contacting portions.

5. The electrical connector as described in claim 4, wherein the third contacting portions are arranged adjacent to the front face of the mating tongue compared with the first contacting portions.

6. An electrical connector comprising:

an insulative housing defining a front mating cavity which is mutually exclusive in accommodating any one of a first, a second and a third types of complementary connector;

a mating tongue extending into the front mating cavity in a first direction and defining thereon first and second mating faces opposite to each other;

a set of first contacting portions arranged and exposed on the first mating face along a second direction perpendicular to the first direction to engage with the first complementary connector;

a set of second contacting portions disposed and exposed on the second mating face along the second direction to engage with the second complementary connector; and a set of third contacting portions disposed and exposed on the second mating face along the second direction which together with the second contacting portions engage with the third complementary connector; wherein the third contacting portions are essentially located in front of both the whole first contacting portions and a primary portions of the second contacting portions in the first direction.

7. The electrical connector as described in claim 6, wherein the third contacting portions are located in front of the whole second contacting portions in said first direction.

8. The electrical connector as described in claim 7, wherein the first and third contacting portions are of stiffness type while the second contacting portions are of resilient type.

9. The electrical connector as described in claim 7, wherein the third contacting portion unitarily connects with the corresponding second contacting portion by a jointing portion.

10. The electrical connector as described in claim 7, wherein the third contacting portion is discrete from the second contacting portion, each of which has a respective corresponding solder tail.

11. The electrical connector as described in claim 7, wherein each of said first, second and third contacting portions corresponds to a corresponding horizontal retention section, and the retention sections of all first, second and third contacting portions being spaced away from one another in a third direction perpendicular to the first and second directions with respective distances larger than those defined by the contacting portions in the third direction.

12. The electrical connector as described in claim 7, wherein the third contacting portions are imbedded in the mating tongue.

13. The electrical connector as described in claim 12, wherein said mating tongue is discrete from remainders of the housing while assembled together.

14. The electrical connector as described in claim 13, wherein said first contacting portions and said second contacting portions are inserted into corresponding passageways of the housing, respectively.

15. An electrical connector comprising:

an insulative housing defining a mating tongue extending in a plane defined by a front-to-back direction and a transverse direction which are perpendicular to each other, said mating tongue defining opposite first and second surfaces both parallel to said plane;

a set of first contacting sections positioned upon the first surface; and a set of second contacting sections and a set of third contacting sections both positioned upon the second surface while being offset from each other in both said front-to-back direction and said transverse direction; wherein said set of first contacting sections and said set of third contacting sections are stiff during mating while said set of second contacting sections are deflectable during mating;

a first pitch is defined by said set of first contacting sections, a second pitch is defined by said set of second contacting sections and a third pitch is defined by said set of third contacting sections under a condition that the first pitch, the second pitch and the third pitch are different from one another.

16. The electrical connector as claimed in claim 15, wherein a metallic shell encloses the housing and receives said mating tongue therein to define a small space facing the first surface and a large space facing the second surface in a vertical direction perpendicular to both said front-to-back direction and said transverse direction.

17. The electrical connector as claimed in claim 15, wherein said set of third contacting sections are offset from said first contacting sections in both said front-to-back direction and said transverse direction

18. The electrical connector as claimed in claim 15, wherein some of said third contacting sections are unitarily formed with corresponding first contacting sections and extend from the second surface toward the first surface, thus share common mounting sections.

* * * * *